US006276986B1

(12) United States Patent
Wu

(10) Patent No.: US 6,276,986 B1
(45) Date of Patent: Aug. 21, 2001

(54) TOY KNITTING MACHINE

(75) Inventor: Wai Kwok Wu, Fanling, New Territories (HK)

(73) Assignee: Acekey Limited, Siu Lek Yuen (HK)

( * ) Notice: Subject to any disclaimer, the term of this patent is extended or adjusted under 35 U.S.C. 154(b) by 0 days.

(21) Appl. No.: 09/290,126

(22) Filed: Apr. 12, 1999

(51) Int. Cl.[7] ..... A63H 33/30
(52) U.S. Cl. ..... 446/474
(58) Field of Search ..... 66/8, 13; 242/153; 446/474

(56) References Cited

U.S. PATENT DOCUMENTS

| | | | |
|---|---|---|---|
| 96,531 | | 11/1869 | Work . |
| 137,568 | | 4/1873 | Platt et al. . |
| 569,463 | | 10/1896 | Minich . |
| 1,291,226 | | 1/1919 | Steed . |
| 1,442,040 | | 1/1923 | Bellamy et al. . |
| 1,518,378 | | 12/1924 | Adams . |
| 2,021,301 | | 11/1935 | Gast . |
| 2,222,992 | | 11/1940 | Steinhardt . |
| 2,539,137 | * | 1/1951 | Hunold ..... 66/8 |
| 2,574,701 | | 11/1951 | Malis . |
| 3,983,719 | | 10/1976 | Rich et al. . |
| 4,133,278 | | 1/1979 | Kimura . |
| 4,372,238 | | 2/1983 | Ciganko . |

FOREIGN PATENT DOCUMENTS

| | | |
|---|---|---|
| 7703585 | 12/1978 | (BR) . |
| 2 077 305 | 12/1981 | (GB) . |
| 10033839 | 10/1998 | (JP) . |
| 2037324 | 10/1991 | (RU) . |

OTHER PUBLICATIONS

1998 Tomy toy; pictures and brochure.
1996 Bandai toy photographs.

* cited by examiner

*Primary Examiner*—Sam Rimell
(74) *Attorney, Agent, or Firm*—Merchant & Gould P.C.

(57) ABSTRACT

A toy knitting machine is provided which includes a lower housing and an upper housing pivotally connected to the lower housing which contains a knitting mechanism positioned therein. The upper housing is pivotable relative to the lower housing between a first position at which the upper housing substantially covers the knitting mechanism preventing access thereto, and a second position at which the upper housing does not cover the knitting mechanism thereby permitting access to the knitting mechanism. By pivotally connecting the upper housing to the lower housing, misplacement and loss of the upper housing is prevented. The toy knitting machine is also designed to make assembly easier and more efficient by reducing the number of assembly steps and preventing incorrect assembly of the machine. In addition, the components of the knitting machine are optimally positioned upon assembly to produce on improved knitted product.

12 Claims, 10 Drawing Sheets

TOY KNITTING MACHINE

FIELD OF THE INVENTION

The invention relates to a toy knitting machine, and in particular to a toy knitting machine of the type that is operable by manually rotating a portion of the toy knitting machine to actuate a knitting mechanism within the machine for creating a knitted strand.

BACKGROUND OF THE INVENTION

Toy knitting machines have been previously designed. One known machine is produced by Tomy Company Ltd. of Japan. This machine utilizes a hand operated crank to rotate a knitting mechanism that is mounted within a housing to create a knitted product. The entire knitting mechanism is separate from the housing thereby requiring that the knitting mechanism be assembled into the housing in a relatively complicated assembly process requiring a relatively large number of assembly steps. Another known knitting machine is produced by the Bandai Company of Japan. The Bandai machine includes a knitting mechanism that is assembled into a housing, with a portion of the housing being rotatable to actuate the knitting mechanism. Like the Tomy machine, the entire knitting mechanism of the Bandai machine must be assembled into the housing in a complicated assembly process.

The knitting mechanisms in the Tomy and Bandai machines are each separate from the machine housings and the components of the knitting mechanisms must be assembled into the housings. In the case of the Tomy machine, the majority of the knitting mechanism is first assembled into a subassembly which must then be positioned into the housing. However, upon positioning within the housing, the subassembly can potentially be located incorrectly, resulting in an incorrect assembly of the machine. The construction of the Bandai machine requires that each individual component of the knitting mechanism must be assembled into the housing, which can result in an incorrect assembly if the components are not positioned correctly within the housing.

Furthermore, the housings of the Tomy and Bandai machines each include a lower housing portion that encloses substantially the entire knitting mechanism and a transparent upper housing portion that is detachably fitted onto the lower housing portion to enable viewing of the knitting mechanism during operation. The upper housing portion, when fitted to the lower housing portion, serves to trap and guide the yarn during knitting. Since the upper housing portion is detachable, it can easily become lost or misplaced, meaning that it can no longer trap and guide the yarn, thereby rendering the machine useless.

What is needed is an improved toy knitting machine that resolves these and other deficiencies of conventional toy knitting machines, as well as providing many added benefits and features not found in conventional toy knitting machines.

SUMMARY OF THE INVENTION

The invention provides an improved toy knitting machine, particularly a toy knitting machine of the type that is operable by manually rotating a portion of the toy knitting machine to actuate a knitting mechanism within the machine. The toy knitting machine is designed to make assembly easier and more efficient by reducing the number of assembly steps and preventing incorrect assembly of the machine. In addition, the components of the knitting machine are optimally positioned upon assembly to produce an improved knitted product. Furthermore, the toy knitting machine is designed to prevent inadvertent loss of the upper housing portion.

In one embodiment in accordance with the principles of the invention, a toy knitting machine is provided which includes a lower housing and an upper housing pivotally connected to the lower housing which contains a knitting mechanism positioned therein. The upper housing is pivotable relative to the lower housing between a first position at which the upper housing substantially covers the knitting mechanism preventing access thereto, and a second position at which the upper housing does not cover the knitting mechanism thereby permitting access to the knitting mechanism. By pivotally connecting the upper housing to the lower housing, misplacement and loss of the upper housing is prevented.

In accordance with another embodiment of the invention, a toy knitting machine is provided which includes a lower housing having a knitting mechanism positioned therein. The knitting mechanism including a plurality of knitting stitches and a knitting stitch guide track is engaged with the knitting stitches for actuating the knitting stitches. The knitting stitch guide track includes a lower guide track portion and an upper guide track portion, with the lower guide track portion being a one piece construction with the lower housing. In addition, an upper housing is engageable with the lower housing, where the knitting stitches are covered by the upper housing when the upper housing is engaged with the lower housing.

Since the lower guide track portion is a one-piece construction with the lower housing, assembly of the machine is facilitated since the position of the lower guide track relative to the lower housing is prefixed and the positioning of other elements, such as the upper guide track portion, can then be reliably and easily performed based upon the pre-positioning of the lower guide track. Furthermore, accurate positioning of the guide track within the lower housing is reliably obtained as the integral lower guide track portion determines the position of the entire guide track.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

DETAILED DESCRIPTION OF THE PREFERRED EMBODIMENT

Figure 1:
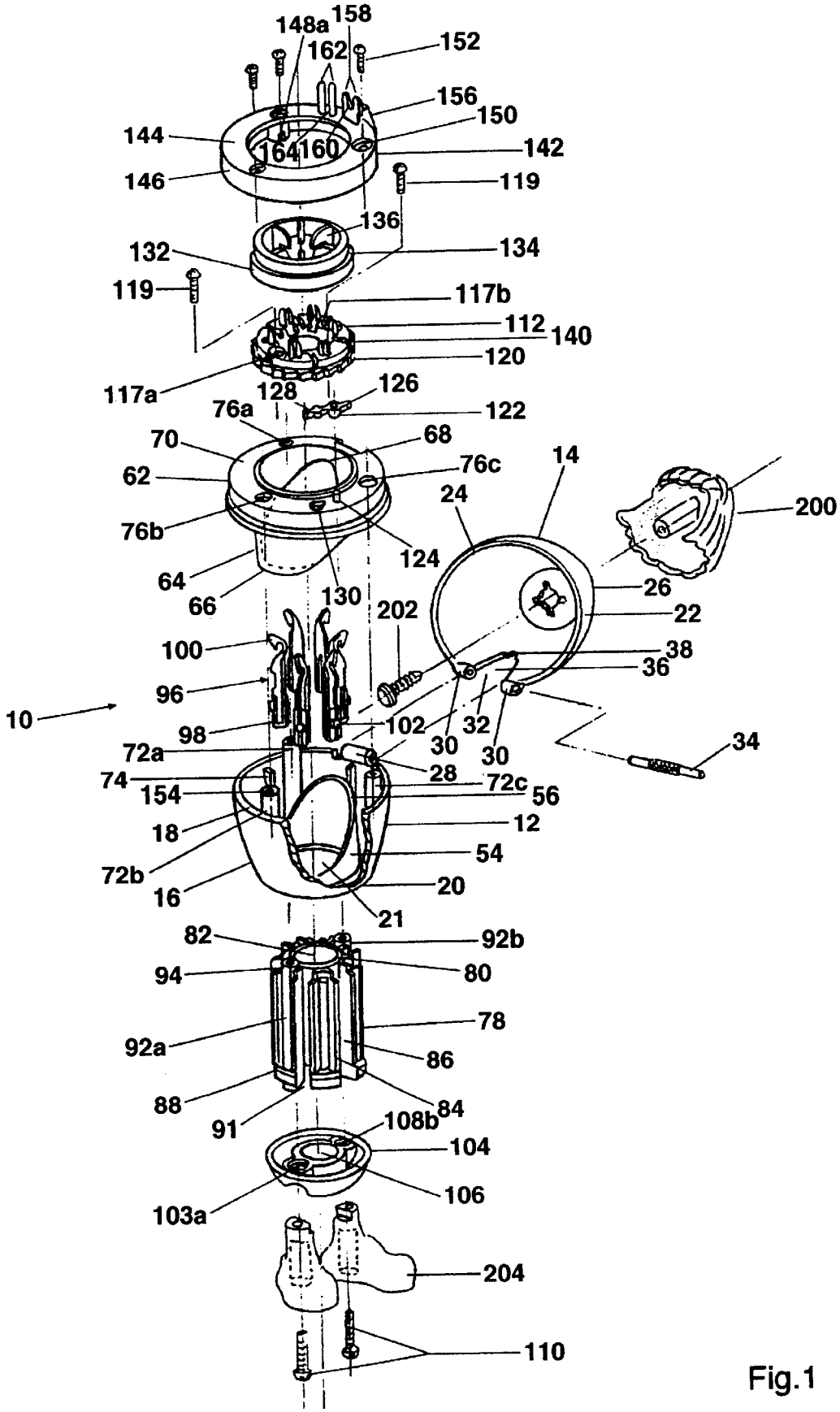
FIG. 1 is an exploded perspective view illustrating the components of the toy knitting machine in accordance with the invention.

The invention relates to a toy knitting machine having a lower housing containing a knitting mechanism capable of performing a knitting operation. An upper housing is pivotally connected to the lower housing for selectively covering and uncovering the knitting mechanism thereby controlling access to the knitting mechanism. By connecting the upper housing to the lower housing with a pivot, loss of the upper housing, which would disable operation of the knitting machine, is prevented.

The invention further provides a toy knitting machine having a lower housing containing a knitting mechanism capable of performing a knitting operation therein. The knitting mechanism includes a plurality of knitting stitches and a knitting stitch guide track engaged with the knitting stitches for actuating the knitting stitches during a knitting operation. The knitting stitch guide track includes a lower guide track portion and an upper guide track portion, with the lower guide track portion being a one piece construction with the lower housing. The machine further includes an upper housing that is engageable with the lower housing for selectively covering and uncovering the knitting mechanism. This construction provides a compact machine in which the knitting mechanism is entirely contained within the upper and lower housings. Furthermore, since the lower guide track portion is a one-piece construction with the lower housing (i.e. integrally formed with the lower housing), assembly of the machine is facilitated and the guide track is always positioned in the optimal position relative to the lower housing upon assembly.

With reference now to the figures, one implementation of the toy knitting machine is illustrated, with the toy knitting machine being referenced generally by the reference numeral 10. FIGS. 9A–D show the knitting machine 10 in its assembled state and illustrate how to use the machine 10, with FIG. 1 providing an exploded perspective view of the elements that when properly assembled, form the machine 10.

Figure 9A:
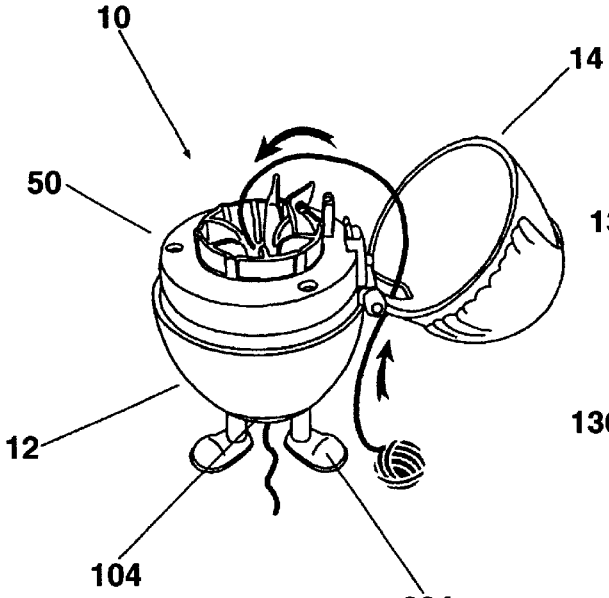
FIGS. 9A, 9B, 9C and 9D illustrate the knitting machine in an assembled condition and demonstrating how to utilize the knitting machine.

Referring initially to FIG. 1, it is seen that the machine 10 includes a lower housing 12 and an upper housing 14 that is adapted to be pivotally connected to the lower housing for pivoting movements relative thereto between a first, covering position (shown in FIGS. 9C, 9D) and a second, open position (shown in FIG. 9A). The lower housing 12 has a generally ring-shaped outer wall 16 having a first end 18 and a second end 20, with the diameter of the outer wall 16 being constantly tapered from the first end 18 to the second end 20 such that the outer wall 16 forms a portion of an oval. The lower housing 12 further includes a discharge hole 21 through the bottom thereof at the second end 20 through which the knitted product exits.

The upper housing 14 includes an outer wall 22 forming generally one-half of a hollow oval shape, with the diameter of the wall 22 constantly decreasing from a first end 24 to a second end 26. Thus, when the upper housing 14 is in its first, covering position relative to the lower housing 12, as seen in FIGS. 9C–D, the outer wall 16 of the lower housing 12 and the outer wall 22 of the upper housing 14 combine to form a substantial portion of an egg shape, thereby giving the machine 10 an egg-shaped appearance.

A pivot post 28 is disposed on the outer wall 16 at the first end 18, and a pair of pivot ears 30 are disposed at the end 24 of the outer wall 22 on either side of a notch 32 provided in the outer wall 22. The distance between the pivot ears 30, and thus the length of the notch 32 at the end 24, is slightly greater than the length of the pivot post 28 such that the pivot ears 30 are disposable on each side of the pivot post 28. An axle 34 is then inserted into aligned passages formed through the pivot post 28 and the pivot ears 30 thereby pivotally connecting the lower housing 12 and the upper housing 14.

The notch 32 in the outer wall 22 includes a tapered section 36 that receives therein an element (described below) mounted on the lower housing 12 when the upper housing 14 is pivoted to the first, covering position, and a rounded section 38 disposed at the end of the tapering section 36. The element that is received in the tapered section 36 cooperates with the rounded section 38 to define a yarn inlet passage 40 to enable passage of a yarn strand 42 through the upper housing 14 and into the interior of the machine 10 as shown in FIG. 9D.

Figure 9B:
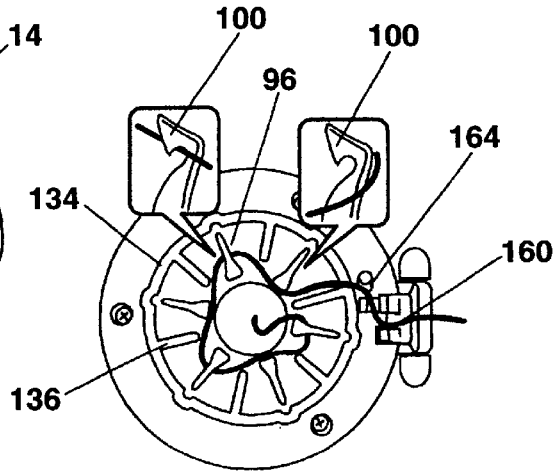
Figure 9C:
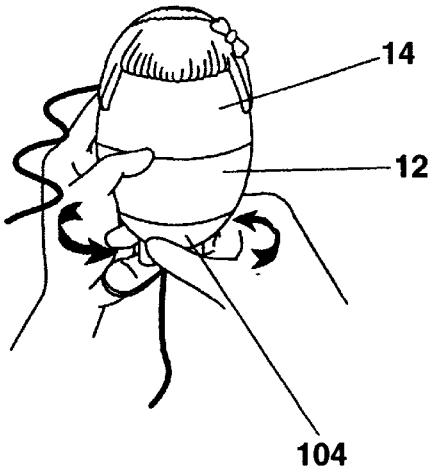
Figure 9D:
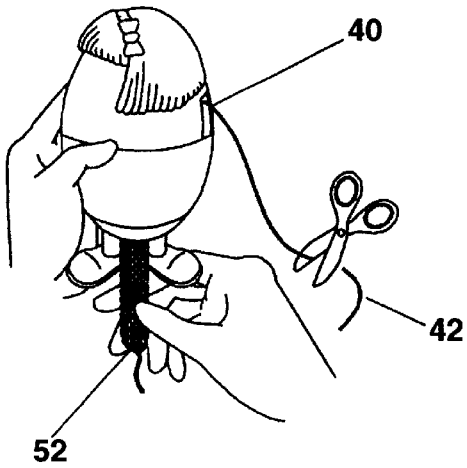

As best seen in FIGS. 9A and 9B, a knitting mechanism 50 is positioned within the lower housing 12 for performing a knitting operation on the yarn strand 42 to produce a knitted strand 52. The knitting mechanism 50 includes a plurality of rotatable and stationary elements that are mounted on and/or within the lower housing 12.

Figure 2A:
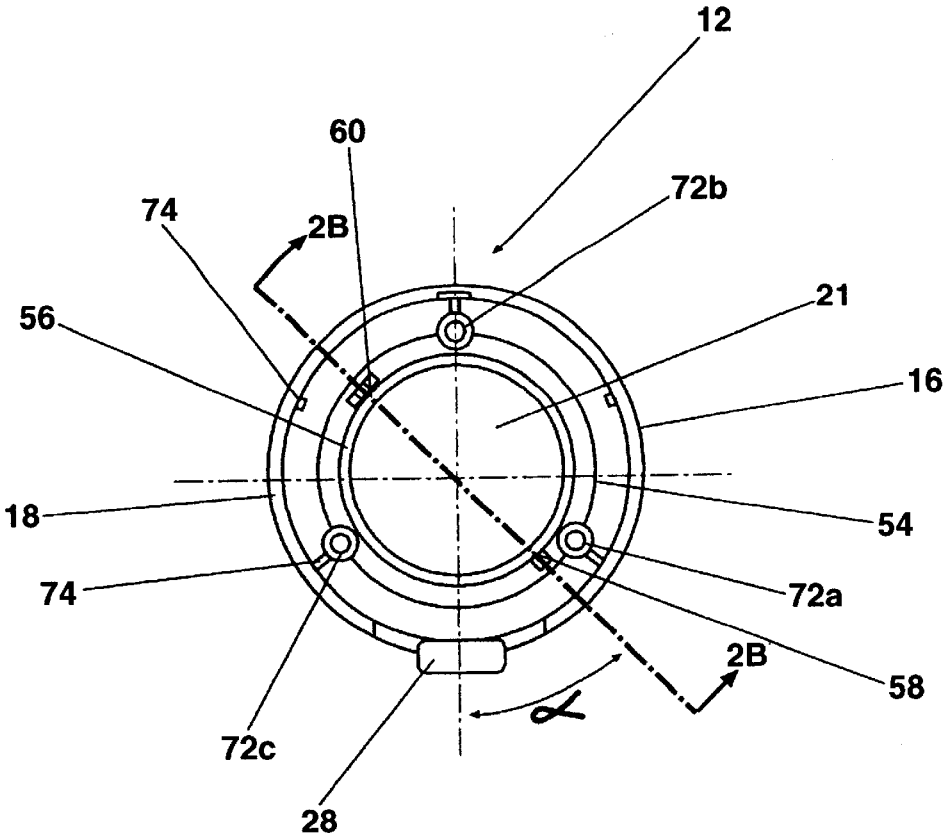
FIG. 2A is a top view of the bottom housing portion showing the bottom of the track integrally formed therewith.
Figure 2B:
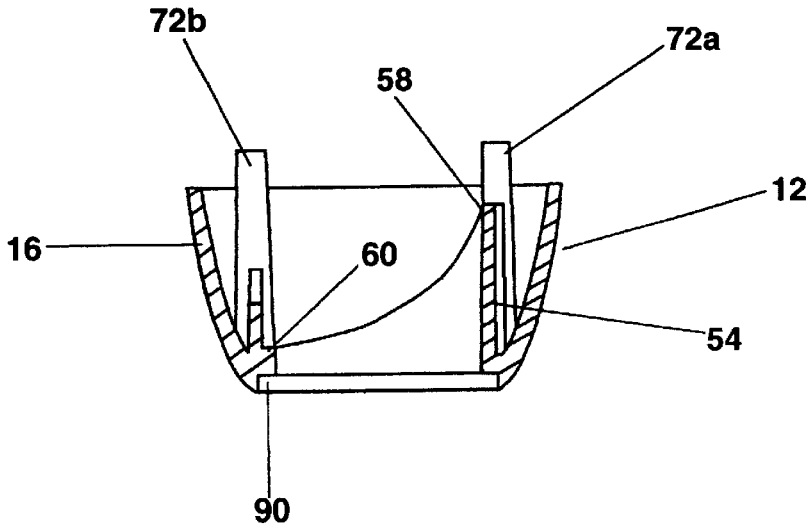
FIG. 2B is a cross-sectional view taken along line 2B—2B of FIG. 2A.

With reference to FIGS. 1, 2A and 2B, the knitting mechanism 50 includes a lower guide track portion 54 that is integrally formed with, i.e. is a one-piece construction with, the lower housing 12 surrounding the discharge hole 21, and projects upwardly in the interior of the housing 12. The track portion 54 is generally circular in construction and has an upper surface thereof 56 that defines the lower part of a knitting stitch guide track 57, described more fully later in the description. As best seen in FIGS. 1 and 2B, the track portion 54 has an apex or highest point 58, as well as a nadir or lowest point 60 (not visible in FIG. 1) located generally diametrically opposite of the apex 58.

Figure 7:
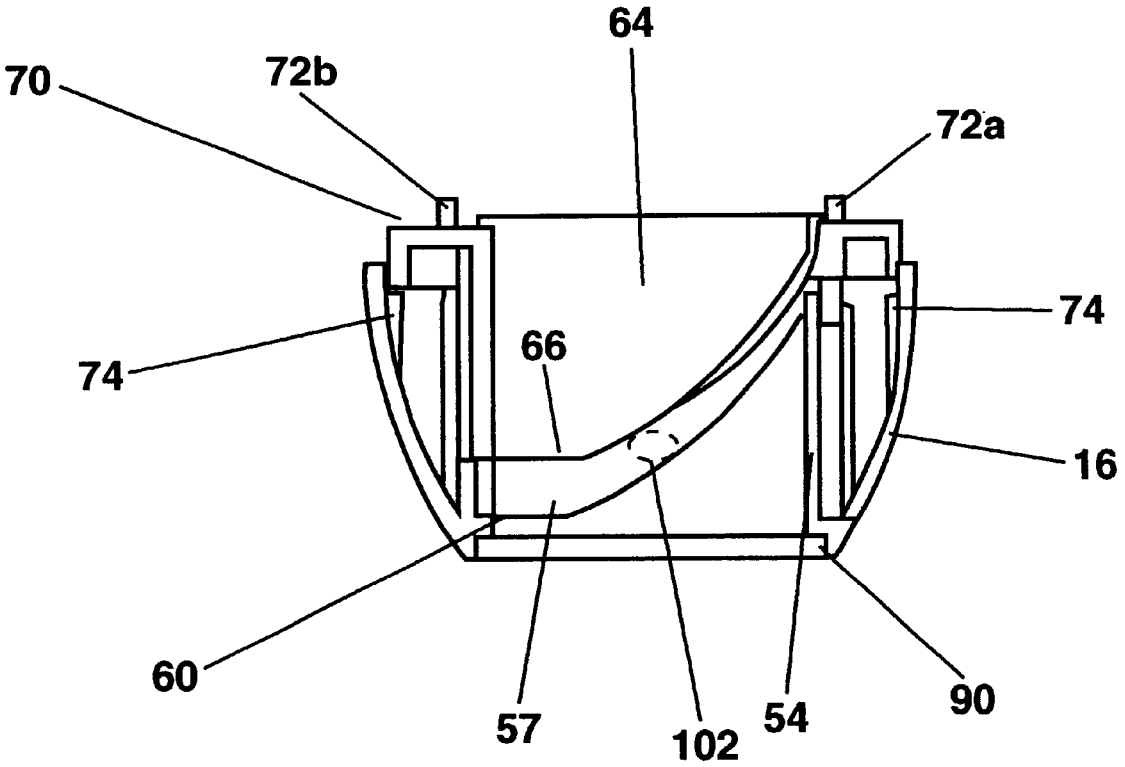
FIG. 7 illustrates the stitch track cover positioned on the lower housing to form the guide track.

With reference to FIGS. 1 and 7, the knitting mechanism 50 further includes a stationary stitch track cover 62 that is connected to the lower housing 12 and includes an upper guide track portion or wall 64 with a bottom surface that is spaced from and faces the upper surface 56 of the lower guide track portion 54 when the cover 62 is mounted on the lower housing 12 to define the aforementioned knitting stitch guide track 57. Like the track portion 54, the track portion 64 is generally circular to define a passage having a diameter generally equal to the diameter of the discharge hole 21, and has an apex or highest point 66 that cooperates with the nadir 60 on the track portion 54 to define the nadir of the guide track 57. The track portion 64 further includes a nadir or lowest point 68 that cooperates with the apex 58 on the track portion 54 to define the apex of the guide track 57.

The cover 62 further includes a generally circular ring portion 70 from which the track portion 64 extends. The lower housing 12 includes three equally spaced posts 72*a,* 72*b,* 72*c* that extend upwardly from the base of the housing 12 between the track portion 54 and the outer wall 16, with the posts 72*a–c* projecting above the first end 18. The lower housing 12 further includes a plurality of shoulders 74 positioned on the interior surface of the wall 16 at a predetermined distance below the first end 18. The outer diameter of the ring portion 70 is slightly less than the diameter of the outer wall 16 at the first end 18 such that the ring portion 70 can fit within the lower housing 12, with the ring portion 70 engaging the shoulders 74 to define its fully inserted position. Furthermore, the ring portion 70 is provided with three equally spaced holes 76*a,* 76*b,* 76*c* therethrough to allow free passage of the posts 72*a–c*. Thus, when the cover 62 is properly positioned, the ring portion 70 engages the shoulders 74, with the posts 72*a–c* passing through the holes 76*a–c,* and the track portion 64 is spaced vertically above the track portion 54 to define the guide track 57 therebetween.

Figure 3A:
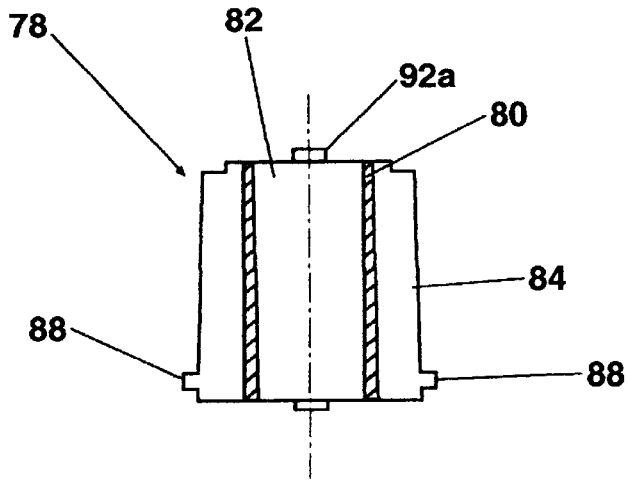
FIG. 3A is a side cross-sectional view through the middle of the stitch barrel.
Figure 3B:
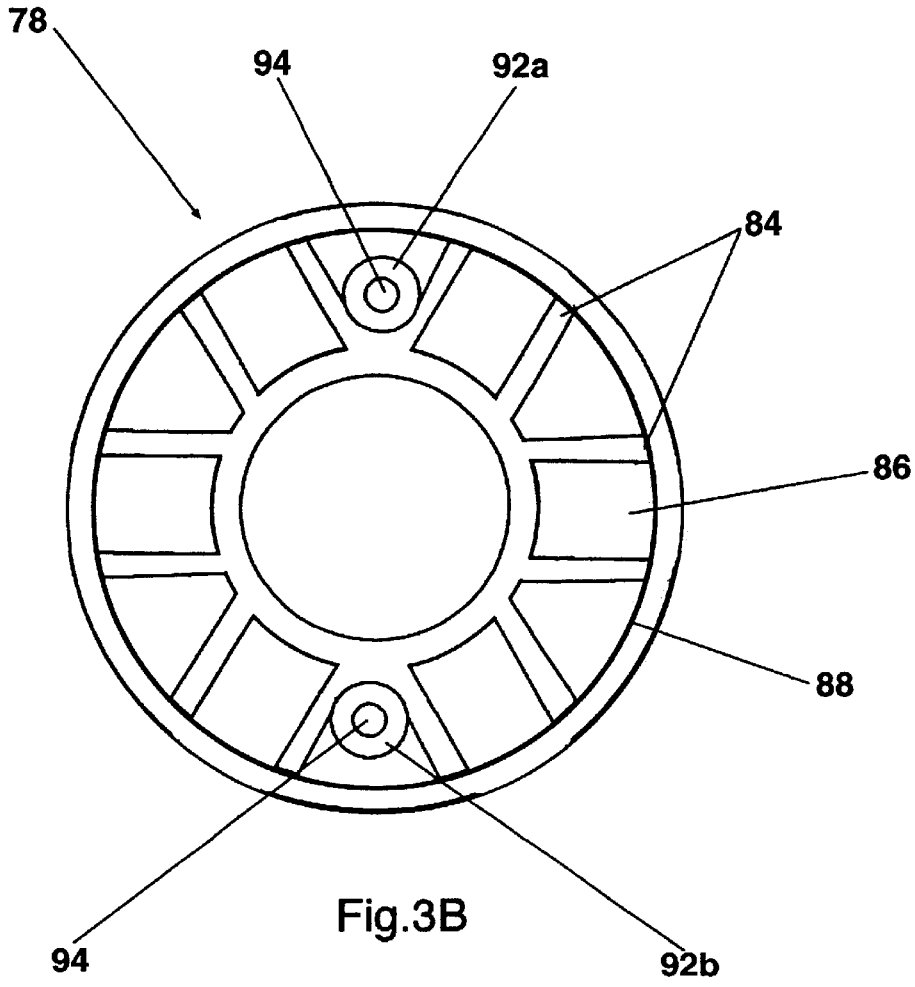
FIG. 3B is a top view of the stitch barrel.

The knitting mechanism 50 also includes a rotatable stitch barrel 78 that is sized for rotatable disposition within the passages defined by, and to be closely surrounded by, the lower and upper track portions 54, 64. Referring to FIGS. 1, 3A and 3B, the stitch barrel 78 includes a central cylinder 80 defining a central passage 82 through which the knitted strand 52 is discharged. A plurality of circumferentially spaced v-shaped pairs of ribs 84 are connected to the outer surface of the cylinder 80 and define therebetween a plurality of, preferably six, stitch guide slots 86. A ring 88 having a diameter slightly larger than the radius of the barrel 78 defined by the ribs 84 interconnects the bases of the ribs 84 and is designed to engage with a circular shoulder 90 (seen in FIG. 7) defined on the lower housing 12 when the barrel 78 is fully inserted. Openings 91 are formed between the ring 88, the cylinder 80 and the ribs 84 defining each slot 86, the purpose of which will be later described.

In addition, a pair of posts 92*a,* 92*b* are disposed in diametrically opposite pairs of ribs 84 and project slightly above and below the cylinder 80, and each projecting post is provided with a threaded bore 94 for receiving screws used to assemble the machine 10, as will be described later in the description.

Figure 3C:
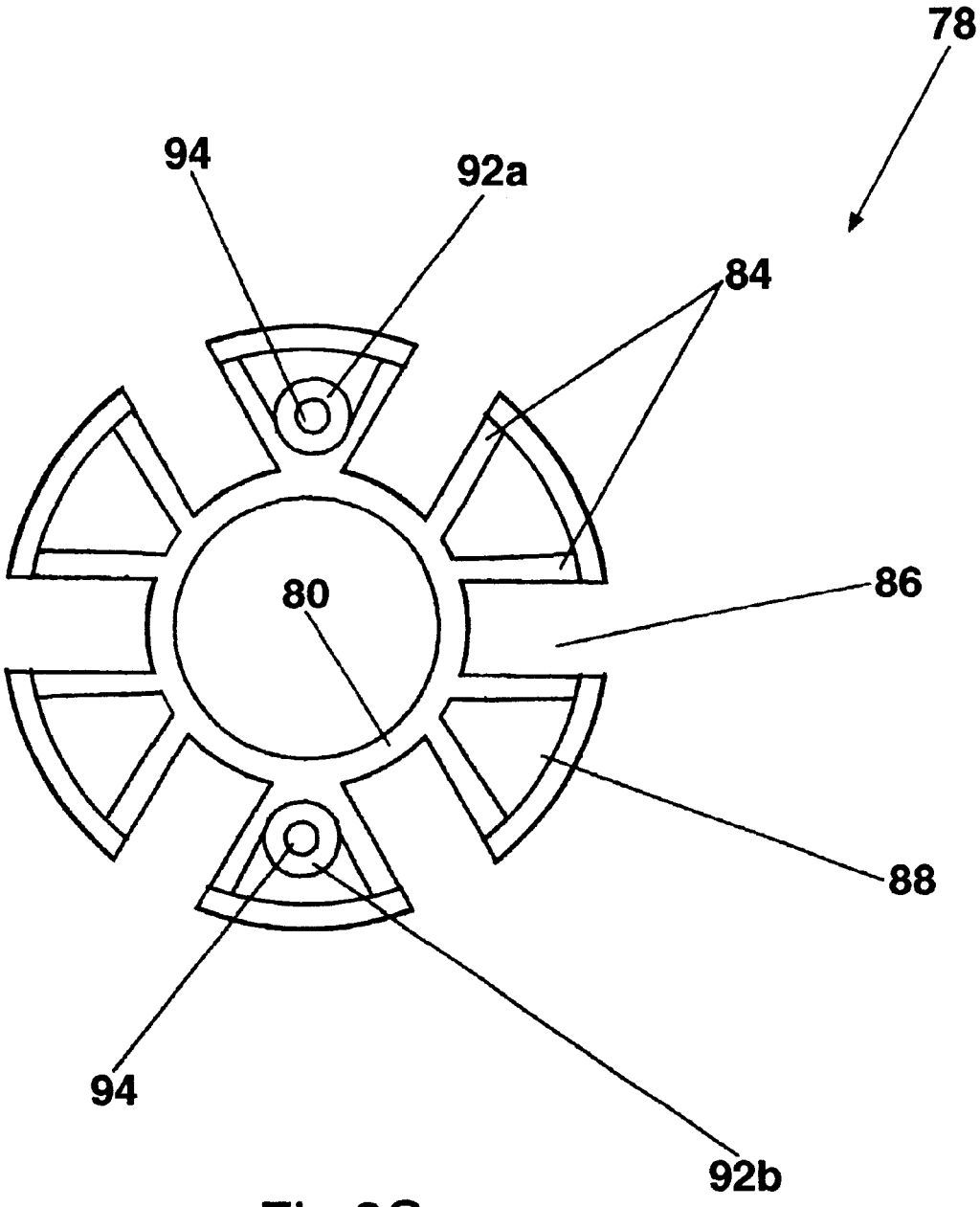
FIG. 3C is a top view of an alternative stitch barrel construction.

Alternatively, as shown in FIG. 3C, the ring 88' of the stitch barrel 78' is made discontinuous, whereby the ring 88' is composed of a plurality of ring portions interconnecting the ribs 84 and leaving the slots 86 open. This construction improves the sliding movements of the knitting stitches (described below) within the slots 86.

Figure 8A:
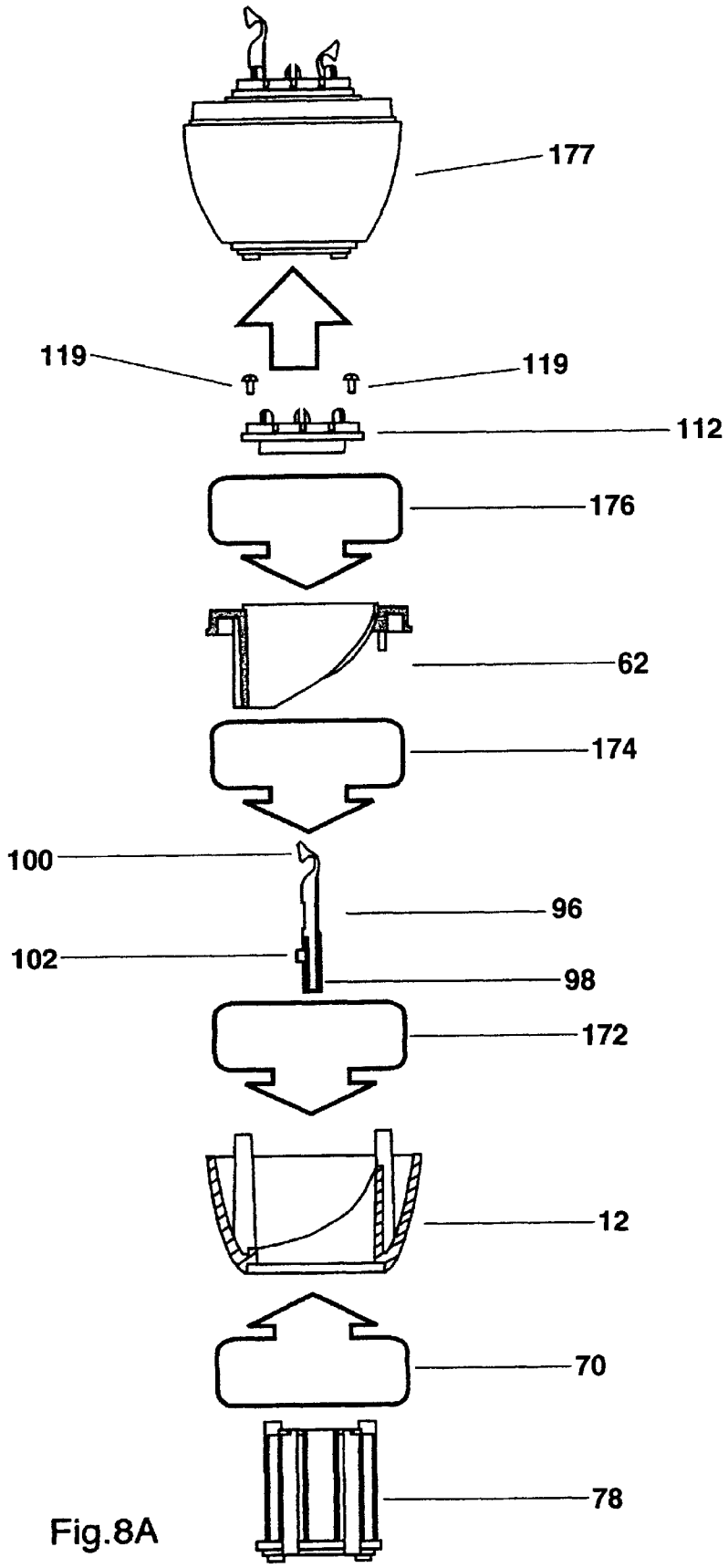
FIG. 8A illustrates the initial steps in assembling the knitting machine to form a main subassembly.

Slidably disposed within each of the guide slots 86 for vertical movements therein, and forming an additional part of the knitting mechanism 50, are a plurality of knitting stitches 96. In the illustrated embodiment, there are six guide slots 86 and therefore six knitting stitches 96. However, it is to be realized that a larger or smaller number of guide slots and knitting stitches could be used if desired. The knitting stitches 96, shown in FIGS. 1 and 8A, are identical to each other with each stitch 96 being generally elongated and including a base end 98 and a hook end 100. The stitches 96 are shaped to enable up and down vertical sliding movements thereof within the respective guide slots 86, with the base end 98 of each stitch 96 being generally rectangular in shape and the intermediate portion of each stitch between the hook end 100 and base end 98 being generally T-shaped. The hook end 100 of each stitch 96 is provided with a hook that engages the yam strand 42 during a knitting operation to knit the strand into a knitted strand 52.

Each stitch 96 further includes a cam projection 102 on the base end 98 thereof that in use is disposed in the stationary guide track 57 such that upon rotation of the stitch barrel 78, the cam projection 102 rides in the guide track 57 which causes the stitch 96 to be actuated up and down within its respective guide slot 86. The stitches 96 are oriented so that the cam projections 102 and the hooks face outwardly. During rotation of the barrel 78, which causes the stitches 96 to move vertically up and down due to the shape of the guide track 57, the base ends of the stitches 96 move down into the openings 91 when the cam projection 102 of the respective stitch is at the nadir of the guide track 57, thereby enabling a full range of vertical movement of the stitches.

A ring shaped lower stitch barrel cover 104 is fastened to the bottom of the stitch barrel 78 and acts as the actuator for causing rotation of the stitch barrel 78. As shown in FIGS. 9A, 9C and 9D, the cover 104 is shaped so as to cooperate with the shape of the lower housing 12 to complete the overall egg-shape of the machine 10. Returning to FIG. 1, the cover 104 has a through passage 106 with a diameter substantially equal to the diameter of the central passage 82 of the barrel 78 to allow passage of the knitted strand 52 therethrough. The cover 104 is further provided with a pair of through holes 108*a,* 108*b* through which screws 110 or the like extend for engagement with the threaded bores 94 in the projecting posts 92*a,* 92*b,* respectively, at the bottom of the barrel 78 so as to enable securement of the cover 104 to the bottom of the barrel 78.

Figure 4A:
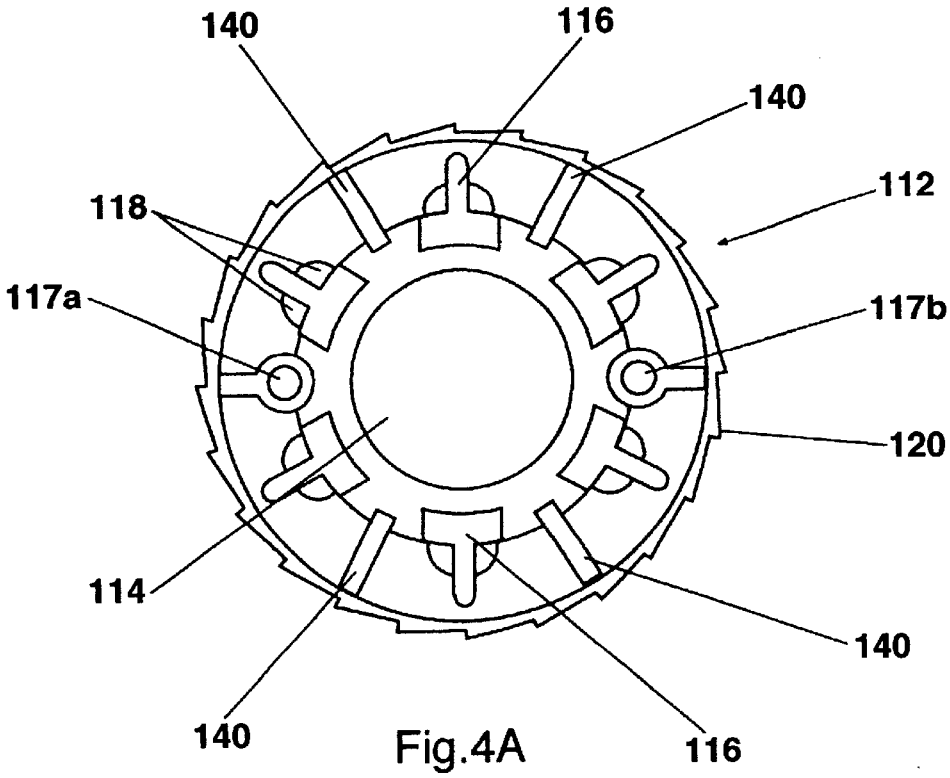
FIG. 4A is a top view of the upper stitch barrel cover.
Figure 4B:
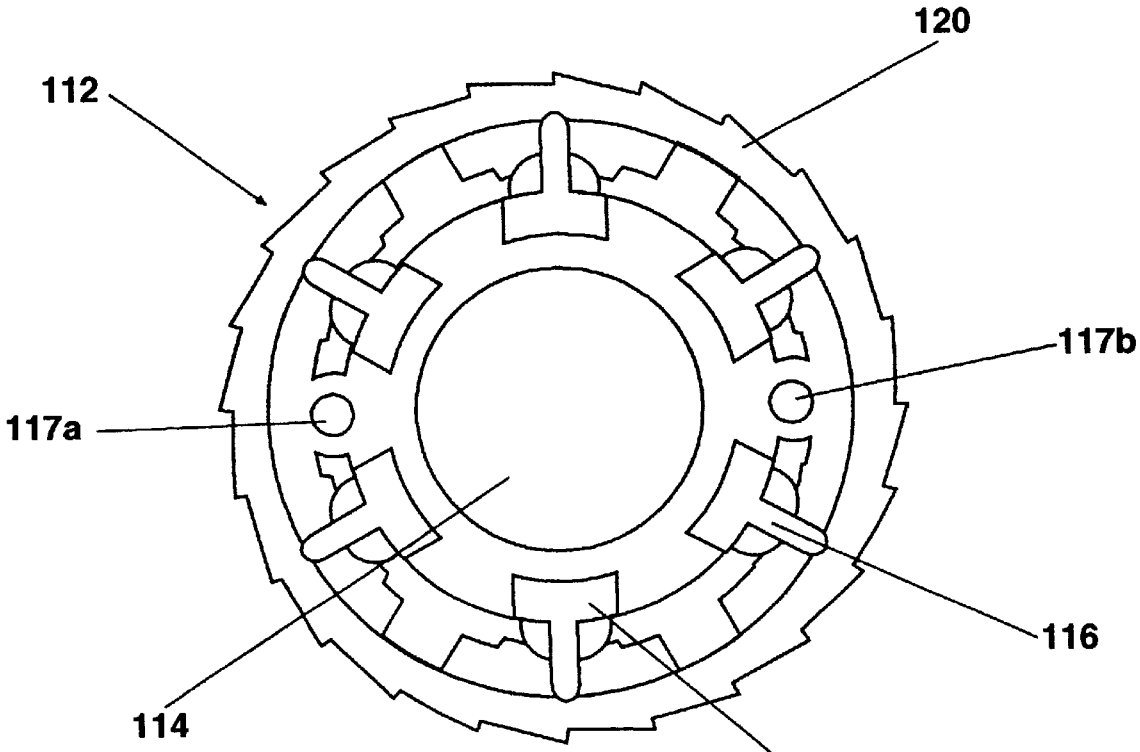
FIG. 4B is a bottom view of the upper stitch barrel cover.

Secured to the opposite end of the barrel 78 is a ring shaped, upper stitch barrel cover 112. The cover 112, shown in detail in FIGS. 1, 4A and 4B, includes a central passage 114 having a diameter approximately equal to the diameter of the central passage 82 of the barrel 78 to allow passage of yarn therethrough. Around the periphery of the cover 112 is a plurality of equally spaced T-shaped passages 116 extending through the cover 112 which allow passage of the knitting stitches 96 through the cover 112 as well as guiding and stabilizing the stitches 96 during their up and down vertical movements. A pair of yarn guide posts 118 associated with each T-shaped passage 116 extend vertically on the sides of the respective passage 116, with the yarn being looped around the guide posts during the knitting operation. The cover 112 further includes a pair of diametrically opposite holes 117*a,* 117*b* therein through which screws 119 extend into threaded engagement with the with the threaded bores 94 in the projecting posts 92*a,* 92*b,* respectively, at the top of the barrel 78 so as to enable securement of the cover 112 to the top of the barrel 78.

The cover 112 further includes ratchet teeth 120 about the bottom periphery thereof forming a part of a one-way rotation mechanism for permitting rotation of the stitch barrel 78 only in a counterclockwise direction as shown by the arrows in FIG. 9C. A pawl 122 is pivotally mounted on a pin 124 provided on the ring portion 70 of the cover 62, with one end 126 of the pawl 122 engaging the ratchet teeth 120 in the event that the barrel 78 and the cover 112 connected thereto are rotated in the clockwise direction. The opposite end 128 of the pawl 122 engages a stop 130 formed on the ring portion 70 to maintain the end 126 in position to prevent clockwise rotation.

The outer diameter of the cover 112 is also sized such that the cover 112 rests on the top surface of the ring portion 70 of the cover 62 when the cover 112 is connected to the barrel 78, thereby preventing the assembly of the cover 104, the barrel 78, and the cover 112 from falling out the bottom of the machine 10.

Figure 5:
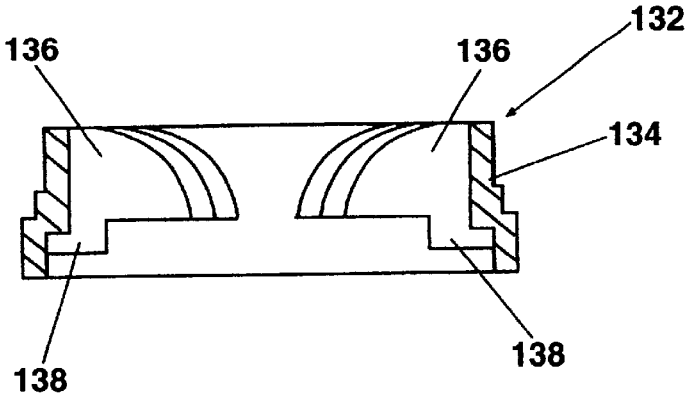
FIG. 5 is a cross-sectional view of the yarn divider ring.

With reference to FIGS. 1 and 5, a yarn divider ring 132 is also provided which rotates with the cover 112 for separating the hooks on each knitting stitch as well as separating the yarn engaged by each hook. The ring 132 has an outer wall 134 that surrounds the top portion of the cover 112, including the T-shaped passages 116 and vertical posts 118, as a bottom surface of the wall 134 is positioned slightly above the top surfaces of the ratchet teeth 120. On the interior surface of the wall 134 a plurality of equally spaced divider plates 136 are disposed, with the plates 136 having mounting portions 138 that is adapted to fit within a respective groove 140 formed in the cover 112, thereby mounting the divider ring 132 on the cover 112 and preventing relative rotation therebetween.

Figure 6A:
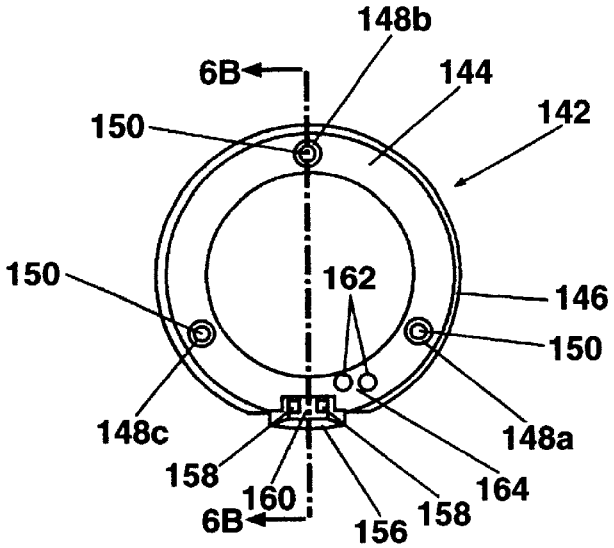
FIG. 6A is a top view of the yarn threading cap showing the offset positions of the yarn guide slots.
Figure 6B:
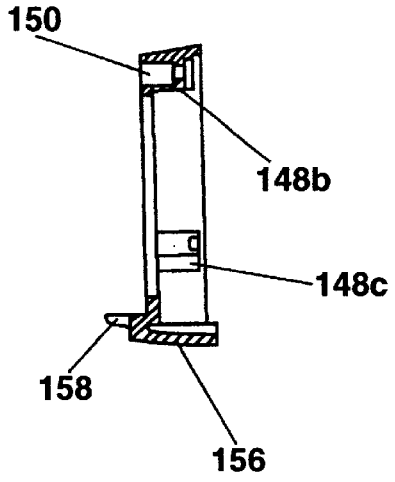
FIG. 6B is a cross-sectional view taken along line 6B—6B of FIG. 6A.

Turning to FIGS. 6A and 6B, along with FIG. 1, a yarn threading cap 142 is provided for guiding the yarn strand 42 that enters through the inlet passage 40 to the knitting stitches 96 and providing tension to the strand 42. The cap 142 is a circular ring formed by a top wall 144 and a side wall 146 that when mounted surrounds the cover 112 and the divider ring 132. Three generally hollow mounting posts 148*a*, 148*b*, 148*c* are disposed inside of the side wall 146 at locations corresponding to the locations of the posts 72*a–c* so that the tops of the posts 72*a–c* extending above the surface of the ring portion 70 are received in the posts 148*a–c*. Holes 150 extend through the top wall 144 and through the posts 148*a–c* to allow passage of screws 152 which thread into threaded holes 154 in the posts 72*a–c* to permit securement of the cap 142 to the lower housing 12.

Disposed on the backside of the side wall 146 of the cap 142 is a tapered element 156 having a shape corresponding to the tapered section 36 of the notch 32 in the upper housing 14, such that when the upper housing 14 is in the covering position, the element 156 fills the tapered section 36 of the notch 32, leaving only the rounded section 38 through which the yarn strand 42 can pass. Positioned on top of the tapered element 156 is a pair of projections 158 defining a slot 160 through which the strand 42 passes. A further pair of projections 162 are disposed on the top wall 144 slightly downstream from the projections 158, with the projections 162 defining a second slot 164 through which the strand 42 passes.

One of the most important aspects of the knitting machine 10 concerns the positioning of the apex of the guide track 57. If the apex is not properly located, the knitting operation is adversely affected. The inventors have discovered that the apex 58 of the track portion 54, and thus the apex of the guide track 57 itself, should be located closely downstream from the point at which the yarn strand enters the machine 10 in order to provide an improved knitting operation. More particularly, as shown in FIG. 2A, the apex 58 should be located at an angle (x from the point at which the strand enters the machine 10, with the angle ox preferably being between about 20 degrees to about 30 degrees, and more preferably about 23.5 degrees.

As described previously, the lower guide track portion 54 is a one-piece construction with the lower housing 12. Therefore, the position of the apex 58 is predetermined by the manufacturing of the lower housing 12 and accurate positioning of the apex of the resultant guide track 57 is always achieved. Thus by making the track portion 54 integral with the lower housing 12, inaccurate positioning of the guide track apex due to assembly error is eliminated.

Referring now to FIG. 8A, assembly of the knitting machine 10 will now be described. Starting with the lower housing 12, the stitch barrel 78 is first inserted into the lower housing as shown by the arrow 170 until the ring 88 abuts the shoulder 90. The knitting stitches 96 are then loaded into the guide slots 86 of the stitch barrel 78, shown by arrow 172, such that the cam projections 102 rest on the top surface 56 of the lower track portion 54. Subsequently, the stitch track cover 62 is positioned, shown by arrow 174, with the guide track portion 64 thereof forming with the lower guide track portion 54 the guide track 57, and with the posts 72*a–c* extending through the holes in the ring portion 70 such that they project above the ring portion 70. The upper stitch barrel cover 112 is then positioned, as shown by arrow 176, and secured to the barrel 78 by the screws 119. The lower stitch barrel cover 104 can also be secured at this time, or the cover 104 could be initially secured to the barrel 78 prior to inserting the barrel into the lower housing 12. Thus in four steps, a main subassembly 177 is created in which the knitting mechanism 50 is completely assembled into the lower housing 12.

Figure 8B:
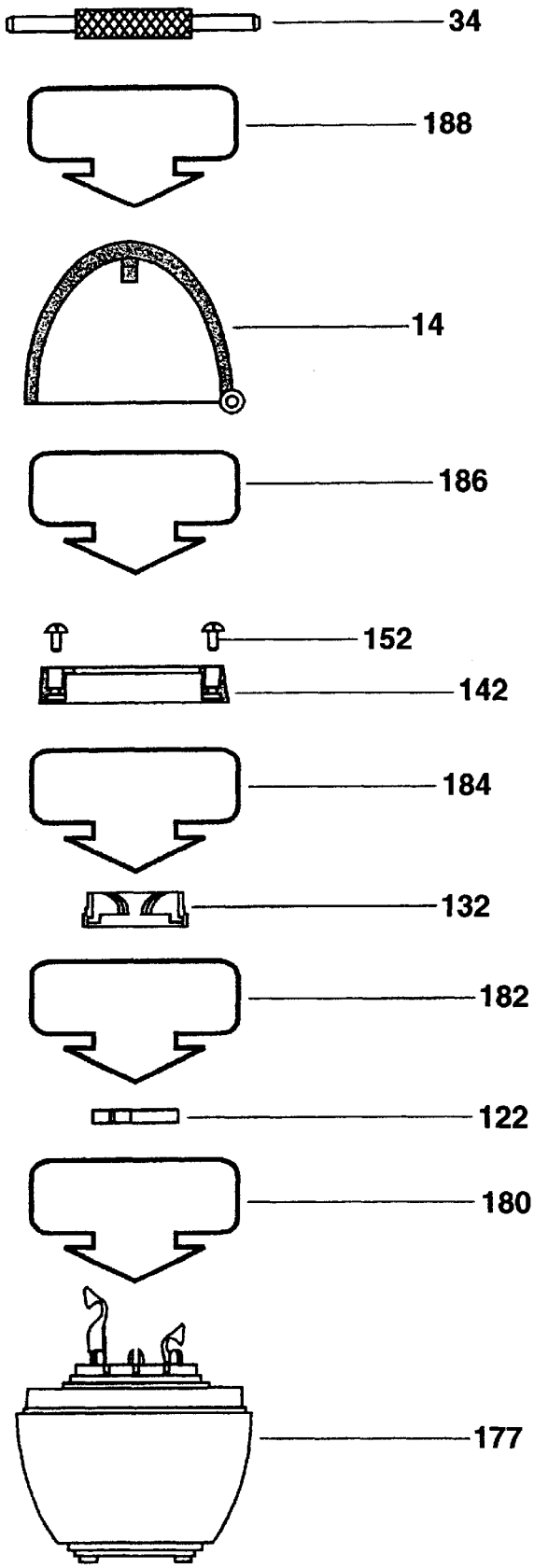
FIG. 8B illustrates the final assembly steps to complete the knitting machine.

Once the main subassembly 177 is created, and as shown in FIG. 8B, the pawl 122 is mounted as shown by arrow 180, the yarn divider ring 132 is then positioned on the cover 112 (arrow 182), and the yarn threading cap 142 is secured to the lower housing 12 (arrow 184) using the screws 152. Thereafter, the upper housing 14 is placed in position (arrow 186) and secured to the lower housing 12 by the axle 34 (arrow 188). Of course, it is to be realized that the components could be assembled in other orders as well. For instance, the upper housing 14 could be secured to the lower housing 12 at any point during assembly, including prior to forming the main subassembly.

The use and operation of the knitting machine 10 will now be described with reference to FIGS. 9A–D. It is assumed that the machine 10 is fully assembled and ready for use. As shown in FIG. 9A, the upper housing 14 is pivoted to the open position, and the yarn strand 42 is passed through the notch 32 and dropped down through the center of the machine 10 until a predetermined length of yarn, such as about 4–5 cm, extend below the machine.

The yarn is then placed around the hooks on the knitting stitches 96 as shown in FIG. 9B, and the yarn is passed through the slots 160, 164 as illustrated. During this step, it is important to make sure that the yarn is in front of the hook on a knitting stitch 96 and then behind the next hook on the adjacent knitting stitch, this pattern being repeated for all the knitting stitches 96.

One the yarn has been properly threaded, the upper housing 14 is closed while ensuring that the yarn remains in position through the slots 160, 164, and knitting can commence. Knitting is started by holding the lower housing 12 and rotating the lower barrel cover 104 in a counterclockwise direction as shown by the arrows in FIG. 9C. Rotation of the cover 104 causes rotation of the barrel 78 and the knitting stitches 96. The cam projections 102 on the stitches 96 ride in the guide track 57, thereby causing the stitches 96 to move vertically upward and downward due to the shape of the guide track 57. The yarn is engaged by the hooks on the ends of the knitting stitches 96 which knit the yarn into the knitted strand 52. After rotating the cover a number of times, such as 5–8 times, it is important to pull down on the end of the yarn strand to prevent the machine from getting stuck with yarn.

Once the desired length of knitted strand 52 is produced, the yarn is cut as shown in FIG. 9D a distance from the hole 40, such as 20 cm, and the lower cover 104 is rotated until the remaining length of yarn has exited the machine 10.

To render the machine 10 more aesthetically appealing, particularly to children, the machine 10 can be provided with features so that the machine simulates a figurine or character.

For instance, with reference to FIGS. 1 and 9C–D, simulated hair 200, or the like, can be affixed to the upper housing 14 via a pin 202. Other features, such as eyes, a nose and a mouth can be integrally formed on, or affixed to, the upper housing, such that the upper housing 14 essentially simulates the head of a character. To complete the character, clothing, arms, etc. can be disposed on the lower housing 12 so as to simulate the body of the character. FIGS. 1 and 9A–D further show feet 204 that can be attached to the cover 104 via the screws 110, thereby simulating the feet of the character. In addition to enabling the simulated character to stand, the feet 204 provide a convenient handle to grasp to aid in rotating the lower cover 104 during the knitting operation.

All the components of the machine 10, except for the screws and the axle, are preferably made from molded plastic, although other materials, including metal, could be used.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A toy knitting machine, comprising:

a lower housing and an upper housing hingedly connected to said lower housing, and a knitting mechanism positioned within said lower housing, said upper housing defining an interior space, and said upper housing being pivotable relative to said lower housing between a first position at which the upper housing substantially covers said knitting mechanism preventing access to said knitting mechanism and a second position at which the upper housing does not cover said knitting mechanism permitting access to said knitting mechanism, and wherein at said first position, at least a portion of the knitting mechanism extends into the interior space of said upper housing.

2. The toy knitting machine according to claim 1, wherein at said first position of said upper housing, said lower housing and said upper housing combine to form an egg shape.

3. The toy knitting machine according to claim 1, wherein said knitting mechanism including a plurality of knitting stitches and a stationary knitting stitch guide track engaged with said knitting stitches, said knitting stitches being rotatable relative to said upper housing and lower housing about a central axis whereby said knitting stitches are actuated by said knitting stitch guide track, and said knitting stitch guide track including a lower guide track portion and an upper guide track portion, said lower guide track portion being a one piece construction with said lower housing.

4. The toy knitting machine according to claim 3, wherein said upper housing includes an inlet passage therein, and said knitting stitch guide track includes an apex and a nadir, said apex being positioned between about 20–30 degrees downstream from said inlet passage in the direction of rotation of said knitting stitches.

5. The toy knitting machine according to claim 4, further including a threading cap secured to said lower housing, said threading cap including a first guide slot and a second guide slot, said second guide slot being positioned downstream from said first guide slot and upstream from said apex.

6. A toy knitting machine, comprising:

a lower housings;

a knitting mechanism positioned within said lower housing, said knitting mechanism including a plurality of knitting stitches and a knitting stitch guide track engaged with said knitting stitches for actuating said knitting stitches, said knitting stitch guide track including a lower guide track portion and an upper guide track portion, said lower guide track portion being unitarily formed with said lower housing; and an upper housing engagable with said lower housing, said knitting stitches being covered by said upper housing when said upper housing is engaged with said lower housing.

7. The toy knitting machine according to claim 6, wherein said lower housing and said upper housing combine to form an egg shape.

8. The toy knitting machine according to claim 6, wherein said knitting stitch guide track is stationary, and said knitting stitches are rotatable relative to said upper housing and lower housing about a central axis.

9. The toy knitting machine according to claim 8, wherein said upper housing includes an inlet passage therein, and said knitting stitch guide track includes an apex and a nadir, said apex being positioned between about 20–30 degrees downstream from said inlet passage in the direction of rotation of said knitting stitches.

10. The toy knitting machine according to claim 9, further including a threading cap secured to said lower housing, said threading cap including a first guide slot and a second guide slot, said second guide slot being positioned downstream from said first guide slot and upstream from said apex.

11. A toy knitting machine, comprising:

a lower housing and an upper housing hingedly connected to said lower housing, and a knitting mechanism positioned within said lower housing, said upper housing being pivotable relative to said lower housing between a first position at which the upper housing substantially covers said knitting mechanism preventing access to said knitting mechanism and a second position at which the upper housing does not cover said knitting mechanism permitting access to said knitting mechanism, and wherein at said first position of said upper housing, said lower housing and said upper housing combine to form an egg shape.

12. A toy knitting machine, comprising:

a lower housing and an upper housing hingedly connected to said lower housing, and a knitting mechanism positioned within said lower housing, said upper housing being pivotable relative to said lower housing between a first position at which the upper housing substantially covers said knitting mechanism preventing access to said knitting mechanism and a second position at which the upper housing does not cover said knitting mechanism permitting access to said knitting mechanism, and wherein said knitting mechanism includes a plurality of knitting stitches and a stationary knitting stitch guide track engaged with said knitting stitches, said knitting stitches being rotatable relative to said upper housing and lower housing about a central axis whereby said knitting stitches are actuated by said knitting stitch guide track, and said knitting stitch guide track including a lower guide track portion and an upper guide track portion, said lower guide track portion being a one piece construction with said lower housing.

* * * * *